US005322287A

United States Patent [19]

Okumoto et al.

[11] Patent Number: 5,322,287

[45] Date of Patent: Jun. 21, 1994

[54] LONG WOOD-TYPE GOLF CLUB

[75] Inventors: Takaharu Okumoto, Chigasaki; Tetsuo Hayashi, Hiratsuka, both of Japan

[73] Assignee: The Yokohama Rubber Co, Ltd., Tokyo, Japan

[21] Appl. No.: 694,551

[22] Filed: May 2, 1991

[30] Foreign Application Priority Data

May 7, 1990 [JP] Japan ..... 2-47488
May 9, 1990 [JP] Japan ..... 2-47664

[51] Int. Cl.[5] ..... A63B 53/08
[52] U.S. Cl. ..... 273/167 F; 273/167 K
[58] Field of Search ..... 273/167 R, 167 G, 167 K, 273/169, 167 F, 80 C, 80 A, 170, 171, 172, 167 A, 167 H, 167 J

[56] References Cited

U.S. PATENT DOCUMENTS 3,819,181 6/1974 Mills ..... 273/167 K
4,883,623 11/1989 Nagamoto et al. ..... 273/167 R

*Primary Examiner*—Vincent Millin
*Assistant Examiner*—Steven B. Wong
*Attorney, Agent, or Firm*—Finnegan, Henderson, Farabow, Garrett & Dunner

[57] ABSTRACT

A long wood-type golf club having a length of 44 inches or more when measured from the bottom of the sole portion of the club's head to the upper end of the club's shaft, the club head having the relationship $h \leqq H$, where h is the vertical height from the bottom of the sole portion of the club head to the axial center of the upper end of the neck thereof and H is the maximum vertical height of the club head's body, the club shaft being inserted into the club head a distance of at least 35 mm.

5 Claims, 3 Drawing Sheets

LONG WOOD-TYPE GOLF CLUB

BACKGROUND OF THE INVENTION

The present invention relates to a wood-type golf club whose club head is formed from a fiber-reinforced resin as a main material, and more particularly to a long wood-type golf club.

Recently, in order to increase the flying distance of a hit ball, wood-type golf clubs whose club heads are formed from a fiber-reinforced resin as a main material have been made longer and longer. Among such lengthened golf clubs, a golf club which measures 44 inches or more from the bottom of the sole of the club head to the end of the club shaft, is called a long wood-type golf club. However, if a golf club is lengthened as described above, the distance between the player and a ball when the player addresses the ball becomes long, and this makes it difficult for the player to have the club head meet exactly the ball. With a long wood-type golf club of this sort, making the club head larger is considered a preferable means for increasing the possibility of an exact meeting.

However, since making the club head larger increases the weight of the club head, a bending load applied to the neck portion where the club shaft is connected to the club head increases, leading to the drawback that the golf club becomes easy to break. Namely, as shown in FIG. 6, in a conventional wood-type golf club, a long neck portion 13 is formed on the club head 11, and an insertion hole 15 is formed in this neck portion 13 so that the club shaft 12 can be inserted thereinto. Since the conventional wood-type golf club is provided with the long neck portion 13 like this, the larger, and hence heavier the club head 11 becomes, the greater becomes the bending load applied to the neck portion 13 at the time of swinging, increasing the possibility that the long neck portion 13 can be easily broken. Due to this, it should be noted that the club head can be made larger only when the breakage of the long neck portion 13 is prevented. Thus, there is a certain limit to an effort in making the club head larger.

SUMMARY OF THE INVENTION

An object of the present invention is to provide a long wood-type golf club in which the club head thereof can be made larger without the neck portion thereof being broken.

Another object of the present invention is to provide a long wood-type golf club in which the club head thereof can be made larger to a volume of 230 ml or larger without the neck portion being broken.

A further object of the present invention is to provide a long wood-type golf club in which the club head thereof can be made larger without the weight thereof being substantially increased.

A still further object of the present invention is to provide a long wood-type golf club in which an exact meeting between the club head and a ball can be easily attained.

In order to accomplish the above objects, a long wood-type golf club according to the present invention comprises a club head formed from a fiber-reinforced resin as a main material, and a club shaft inserted into the club head so as to be secured thereto through the upper end of a neck portion formed at the end of the club head, and the length of the golf club when measured from the bottom of the sole of the club head to the upper end of the club shaft is set to be 44 inches or more. In this golf club construction, the relationship between the vertical height h from the bottom of the sole of the club head to the upper end of the neck portion and the vertical height H of the club head main body is set to be $h \leqq H$, and the insertion length l of the club shaft into the club head is set to be at least 35 mm.

The above construction allows the neck portion of the club head to be made shorter than that of a conventional club head, thereby making it possible to add a volume equivalent to that of neck portion that has been shortened to the volume of the club head main body. Thus, the club head can be made larger without substantially increasing its weight, and this makes it possible to easily obtain a club head whose volume is 230 ml or larger which is regarded as being ideal for a long wood-type golf club.

In addition, shortening the neck portion serves to increase the bending rigidity of the neck portion, and this serves in turn to make the connection portion strong and rigid by inserting and fixing the club shaft with the insertion length l of the club shaft set to at least 35 mm, and even if the weight of the club shaft has to be slightly increased, the neck portion becomes less breakable. Furthermore, even with a long wood-type golf club, a larger club head can meet a ball more exactly.

DETAILED DESCRIPTION OF THE PREFERRED EMBODIMENTS

Figure 1:
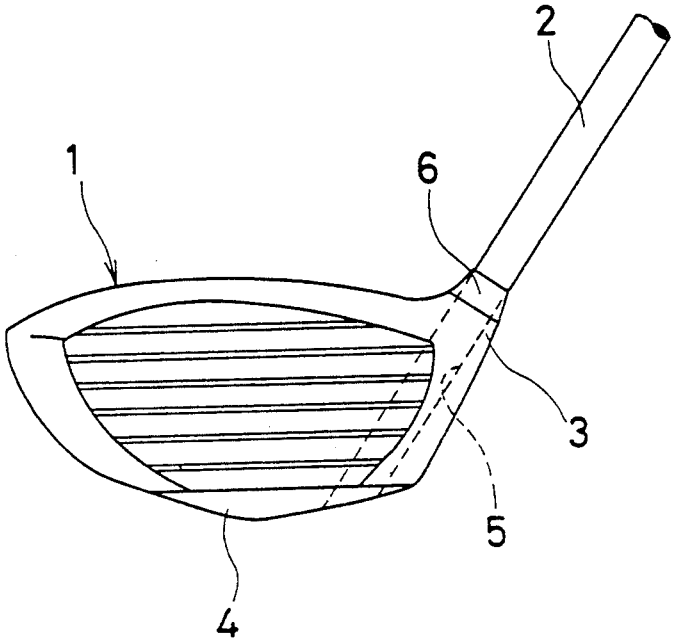
FIG. 1 is a front view of a wood-type golf club according to one embodiment of the present invention.

In FIG. 1, reference numeral 1 denotes a club head formed from a fiber-reinforced resin as a main material, and reference numeral 2 denotes a club shaft. The club head 1 has a neck portion 3 formed on one side thereof and a sole portion 4 provided on the bottom portion thereof. An insertion hole 5 is formed in the neck portion 3 of the club head 1 in such a manner as to extend from the upper end of the neck portion 3 to the under side of the sole portion 4, and the club shaft 2 is inserted into this insertion hole 5 so that it reaches the under side of the sole portion 4 for bonding and fixing. A socket 6 is mounted on the upper end of the neck portion 3 in such a manner as to surround the club shaft 2. In a wood-type golf club constructed as described above, the length of the club is 44 inches or more when measured from the bottom of the sole portion 4 of the club head 1 to the upper end of the club shaft 2.

Figure 2:
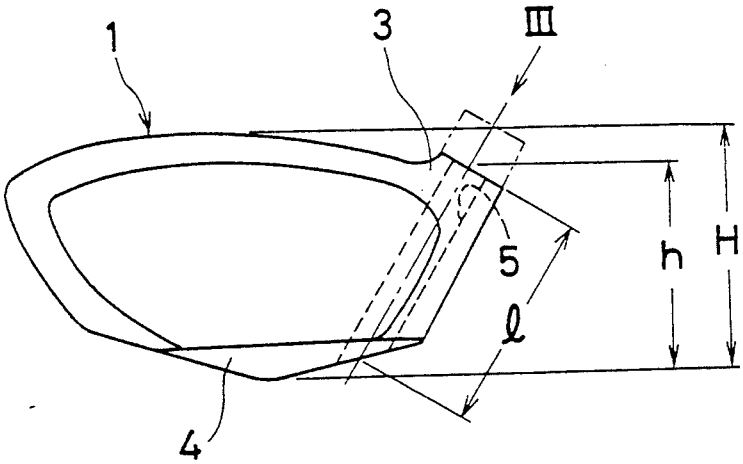
FIG. 2 is a front view showing only the main part of the golf club of FIG. 1.
Figure 4:
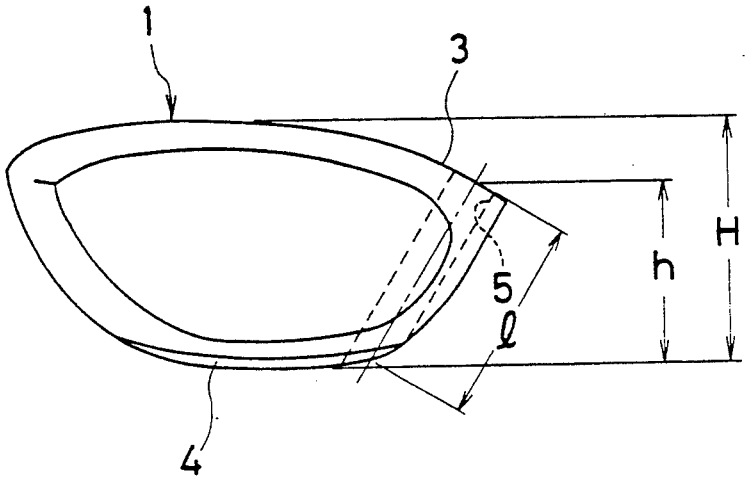
FIG. 4 is a front view showing only the main part of a club head of a wood-type golf club according to another embodiment of the present invention.
Figure 6:
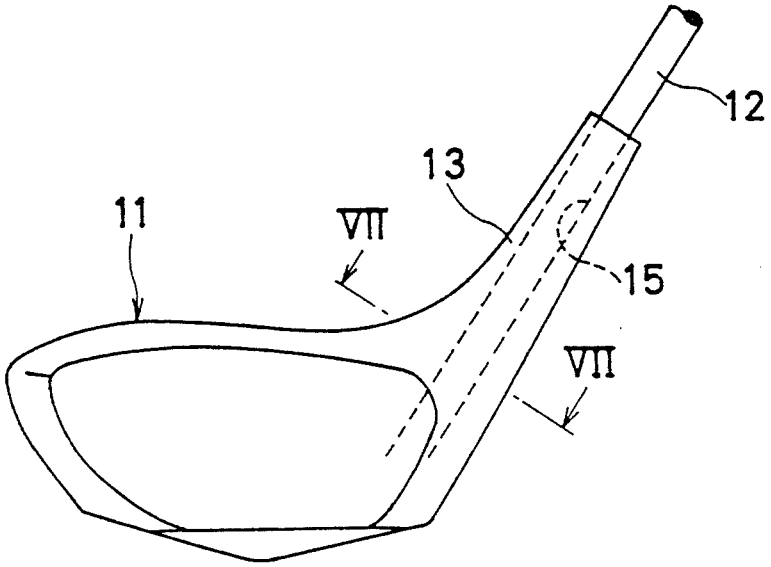
FIG. 6 PRIOR ART
FIG. 6 is a schematic front view of a conventional wood-type golf club.

As shown in FIG. 2, the above club head 1 is formed such that the neck portion 3 becomes substantially shorter than that of a conventional club head shown in FIG. 6. The vertical height h from the upper end of the axial center of the insertion hole 5 for club shaft 2 in neck portion 3 to the bottom side of the sole portion 4 thereof is equal to or less than the maximum vertical height H of the club head's main body. In other words, the above-mentioned vertical height h is in a relationship expressed as $h \leqq H$, and its upper limit is shown by chained lines in FIG. 2. Thus, the limitation to the height as described above serves to remarkably increase the bending rigidity of the neck portion 3, and this prevents easy breakage of the neck portion due to the bending load produced at the time of swinging the club shaft even if the weight of the club head 1 is increased when the club head 1 is made larger. As shown in FIG. 4, the lower limit of the vertical height h of this neck portion 3 is such that the projection of the neck portion 3 is substantially on a level with the top side of the club head's main body.

In addition, in the above club head 1 according to the present invention, a volume corresponding to the volume of the part of the neck portion 3 that has been shortened may be utilized as an additional volume to the main body portion, thereby making it possible to make the club head 1 larger without substantially increasing the weight thereof. Namely, according to the above club head 1, it is possible to make the club head larger than the conventional club head having a shape as shown in FIG. 6 while maintaining its weight at a level identical with that of the conventional club head. Furthermore, since the bending rigidity of the above neck portion 3 becomes high due to the shortening of the neck portion 3, even if the weight of the club head is increased slightly over that of the conventional club head, it can fully bear the bending load generated at the time of swinging.

Therefore, according to the above club head 1, it is easy to set the volume thereof to be equal to or larger than 200 ml so that the neck portion 3 is free from any damage, and moreover, it is also easy to set the volume of the club head 1 to be equal to or more than 230 ml which is ideal for a long wood-type golf club.

Preferably, the club's balance is equal to or less than C4. A club's balance is defined by swingweight, which is calculated according to:

Swingweight (inch ounces) = A (inches) × W (ounces) in which A is the distance in inches between the center of gravity of the golf club and a position 12 inches in from the grip end of the club and W is the total weight in ounces of the club.

A swingweight range of from 220 to 260 inch ounces for a wood club is divided or scaled into 21 equal intervals which are marked C0 to E0, namely C0, C1, . . . C9, D0, D1, . . . D8, D9, E0, consecutively. These letter-number marks are known as the club's balance. Thus according to this scale, a club balance of C4 for a wood club is equal to a swingweight of 228 inch ounces or 19 ounces (228 inch ounce/12 inches).

In order to securely fix the club shaft 2 to the club head 1 whose neck portion 3 is made shorter, the insertion length l of the club shaft 2 needs to be set to be at least 35 mm. In a case where the insertion length l is shorter than 35 mm, the bonding portion for the club shaft 2 is insufficient, and due to this, it is difficult for the neck portion to bear the bending load generated when a golf club whose club head is made larger is swung. The upper limit of this insertion length l is preferably about 50 mm, since the vertical height of the club head 1 is substantially 50 mm.

Figure 3:
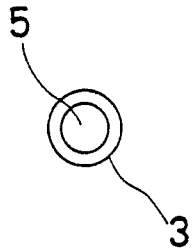
FIG. 3 is a view as seen in a direction indicated by arrow III in FIG. 2.
Figure 7:
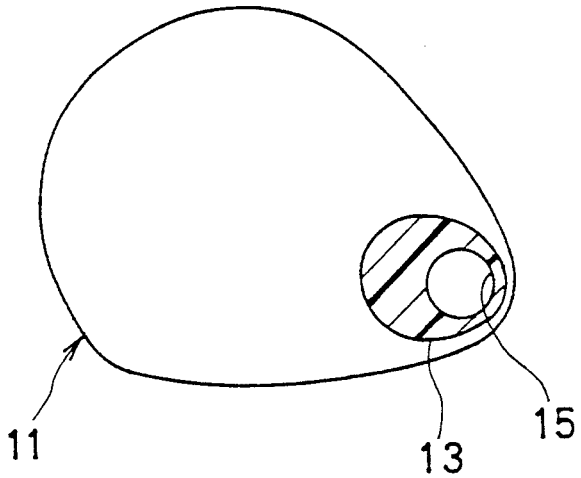
FIG. 7 PRIOR ART
FIG. 7 is a view as seen in a direction indicated by arrow VII—VII in FIG. 6.

The upper end of the neck portion 3 of the golf club according to the present invention is, as shown in FIGS. 2 and 3, formed into a plane that intersects the axis of the club shaft 2 at right angles, and its outer circumferential edge forms a concentric circle whose axial center coincides with the axial center of the club shaft insertion hole 5. Since the upper end of the neck portion is formed into such a shape, a truncated cone-like socket 6 can be simply placed on the neck portion. It is not possible to obtain the shape of the upper end portion of the neck portion 3 simply by cutting the neck portion of a conventional club head as shown in FIG. 6 at a lower position, for instance, at a lower position shown by line VII—VII. As shown in FIG. 7, the sectional configuration of such a cutting of the neck portion 3 would be a deformed oval shape which is eccentric with the axial center of the shaft insertion hole 5. Furthermore, in a case where the upper end of the neck portion 3 is formed into a deformed oval shape like this, it is not possible to mount the truncated cone-like socket 6 thereon, this making even more difficult processability of the golf club.

Figure 5:
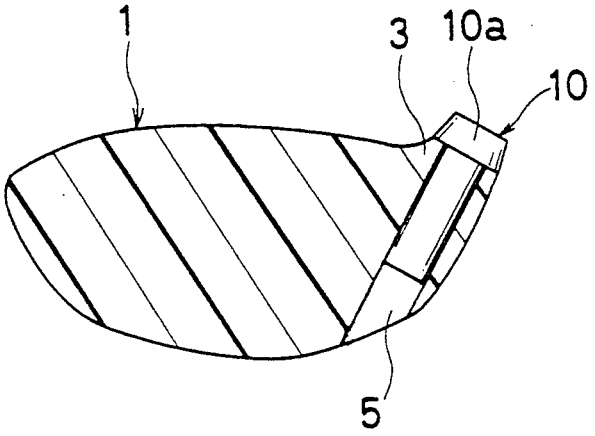
FIG. 5 is a sectional view of the main part of a club head according to the present invention explaining one example of manufacturing the same.

In order to process the upper end surface of the neck portion 3 such that it forms a circle concentric with the axial center of the club shaft insertion hole 5, it is preferable to use a processing tool 10 as shown in FIG. 5. This processing tool 10 is formed such that it has a head portion 10*a* formed from an abrasive material such as ceramics. This processing tool 10 is then inserted into the insertion hole 5 formed in the club head 1, and if the neck portion 3 on the periphery of the processing tool 10 is abraded, the upper end surface of the neck portion 3 will be formed into a circle that is concentric with the axial center of the insertion hole 5.

As is described above, according to the present invention, since the neck portion of the club head is made shorter, it is possible to add a volume corresponding to that of the part of the neck portion that has been shortened to the volume of the club head main body, thereby making it possible to make the club head larger without a substantial increase in weight. In addition, since the bending rigidity of the neck portion is increased by making the neck portion shorter, it is possible to make the connection portion strong and rigid by inserting and fixing the club shaft with the club shaft insertion length l set to at least 35 mm, thereby making it possible to prevent easy breakage of the neck portion even if the weight of the club head is increased to some extent.

What is claimed is:

1. A long wood-type golf club comprising a club head body formed primarily of a fiber-reinforced resin, said club head body having an upper portion having an upper side surface, a sole portion having a lower side surface, and a neck portion formed on one side of said upper portion, said neck portion having an upper end with an insertion hole formed therein that extends downwardly through the body of club head toward said sole portion and a club shaft inserted into and secured in place in said insertion hole to a depth of at least 35 mm, the length of said club being 44 inches or more when measured from the lower side surface of the sole portion of said club head to the upper end of said club shaft, the club head body having a vertical height h measured from said lower side surface of the sole portion to the axial center of the insertion hole on the upper end of said neck portion less than or equal to the maximum vertical height H of the club head body measured from said lower side surface of the sole portion to said upper side surface of the upper portion and volume of 230 ml or larger, the club's balance being equal to or less than a value of C4.

2. The long wood-type golf club of claim 1, wherein the insertion length of said club shaft in said club head body is from 35 to 50 mm.

3. The long wood-type golf club of claim 1, wherein the upper end of said neck portion is formed flush with the upper side surface of said club head body.

4. The long wood-type golf club of claim 1, wherein the upper end of said neck portion is perpendicular to the axis of said club shaft and the insertion hole and has an outer peripheral circular edge concentric with said axis and a socket is mounted on said upper end of said neck portion that surrounds said club shaft adjacent said club head body.

5. The long wood-type golf club of claim 1, wherein the lower end of said club shaft extends down into said sole portion of said club head body.

* * * * *